US009446833B2

(12) United States Patent
Flodgaard

(10) Patent No.: US 9,446,833 B2
(45) Date of Patent: Sep. 20, 2016

(54) SYSTEM AND A METHOD FOR CONTROL OF THE RPM OF AT LEAST ONE MAIN ENGINE OF A VESSEL

(71) Applicant: DEIF A/S, Skive (DK)

(72) Inventor: Esper Flodgaard, Skive (DK)

(73) Assignee: Deif A/S, Skive (DK)

( * ) Notice: Subject to any disclaimer, the term of this patent is extended or adjusted under 35 U.S.C. 154(b) by 0 days.

(21) Appl. No.: 14/436,361

(22) PCT Filed: Oct. 17, 2013

(86) PCT No.: PCT/DK2013/050334

§ 371 (c)(1),
(2) Date: Apr. 16, 2015

(87) PCT Pub. No.: WO2014/059995

PCT Pub. Date: Apr. 24, 2014

(65) Prior Publication Data

US 2015/0247416 A1 Sep. 3, 2015

(30) Foreign Application Priority Data

Oct. 18, 2012 (DK) ..... 2012 70636

(51) Int. Cl.
*B63H 25/42* (2006.01)
*B63J 3/02* (2006.01)
(Continued)

(52) U.S. Cl.
CPC ..... *B63H 25/42* (2013.01); *B63B 35/4413* (2013.01); *B63J 3/02* (2013.01); *B63J 2003/002* (2013.01); *F02D 29/02* (2013.01); *F02D 41/021* (2013.01); *F02D 41/0205* (2013.01)

(58) Field of Classification Search
CPC ..... F01D 15/045; B63H 25/42; B63H 2025/425; B63H 25/50; B63H 25/00; B63H 25/02
See application file for complete search history.

(56) References Cited

U.S. PATENT DOCUMENTS 6,379,114 B1 4/2002 Schott et al.
2005/0164574 A1* 7/2005 Levander ..... B63H 5/08 440/79
2010/0274420 A1 10/2010 Veit et al.

FOREIGN PATENT DOCUMENTS

EP 2226245 3/2009
JP 2004345628 12/2004
WO 03099651 12/2003

OTHER PUBLICATIONS

English Abstract of JP 2004345626.
(Continued)

*Primary Examiner* — Richard Edgar
(74) *Attorney, Agent, or Firm* — Nixon Peabody LLP

(57) ABSTRACT

The present invention relates to a system and a method for control and reduction of the RPM of at least one main engine of a vessel, which main engine drives at least one first propeller for propulsion, which first propeller is pitch-regulated, which second thruster propeller is pitch-regulated. It is the object of the invention to reduce the RPM of one ore more main engines of a vessel and by increasing the pitch of the propellers to maintain constant propulsion, and by reducing the RPM of the main engines to re-duce the fuel consumption and in this way reduce pollution. The object can be fulfilled by a system analysing the RPM and pitch of the first main shaft propeller, which system analyses the RPM and the pitch of the second thruster propeller, which system based on said analyses performs downward regulation of the RPM of the main engine.

12 Claims, 5 Drawing Sheets

(51) Int. Cl.

| | |
|---|---|
| *B63B 35/44* | (2006.01) |
| *F02D 41/02* | (2006.01) |
| *F02D 29/02* | (2006.01) |
| *B63J 3/00* | (2006.01) |

(56) References Cited

OTHER PUBLICATIONS

English Abstract of EP 2226245.

* cited by examiner

SYSTEM AND A METHOD FOR CONTROL OF THE RPM OF AT LEAST ONE MAIN ENGINE OF A VESSEL

FIELD OF THE INVENTION

The present invention relates to a system and a method for controlling and optimizing the RPM of at least one main engine of a vessel, which main engine drives at least one pitch regulated main propeller for propulsion, which main propeller is pitch-regulated which main engine drives at least one main generator, which main generator drives at least one thruster motor, which thruster motor drives at least one thruster propeller which thruster propeller is pitch-regulated.

BACKGROUND OF THE INVENTION

EP 2226245 relates to a drive system for a vessel, comprising at least one drive shaft driving a propeller, an arrangement of electric drives disposed on the drive shaft, an arrangement of generators for supplying power to the electrical drives, and a control unit. The power supplied to the propeller by means of the electric drives can be controlled by means of the control unit as a function of the characteristic curve of the propeller, which defines the maximum achievable thrust of the propeller as a function of the rotational speed.

OBJECT OF THE INVENTION

It is the object of the invention to reduce the RPM of one ore more main engines of a vessel and by increasing the pitch of the propellers to maintain constant propulsion, and by reducing the RPM of the main engines to reduce the fuel consumption and in this way reduce pollution.

DESCRIPTION OF THE INVENTION

The object can be fulfilled by a system as disclosed in the preamble to claim 1 if further modified if the system analyses the RPM and pitch of the main shaft propeller, which system analyses the RPM and the pitch of the thruster propeller, which system is based on said analysis, which system receives a plurality of input from another control system in the vessel, which system performs regulation of the RPM of the main engine between a low and a high threshold level during normal operation of the vessel, and which system performs regulation of RPM of the main engine by lowering the RPM of the main engine to a level below the low threshold RPM level during a period when the vessel is maintaining a constant position or a constant low speed, which system performs regulation of the pitch of at least the main propeller for compensating for the low RPM level of the main engine.

Normal operation of the vessel is defined as when the vessel is travelling at a certain speed. During normal operation the RPM of the at least one main engine runs at RPM between a low and a high threshold. The low RPM threshold results in the engine running in an idle mode and the high threshold level represents the maximum value at which the main engine can operate during normal propulsion of the vessel.

Hereby it can be achieved, that the engine will be able to conserve fuel, if there is no degradation in performance of the primary regulated quantity, normally the position of the ship. In many situations where vessels such as ships have to be placed at the same position, for example in connection with drilling from oil or gas wells, the vessels must be placed at precisely the same position for a longer period of time. Because current and wind will move the vessels, they must always operate with the main engine rotating and also the main propeller rotating in order to achieve the correct position in water. This process is called Dynamic Positioning. In order to maintain the position of the vessel correctly, there will often also be a number of thruster propellers which are operated by electric motors, and in order to obtain a regulation in the propulsion of the propellers, the propellers are pitch-regulated, so in fact the propellers can rotate without acting any force upon the water. If a propeller has to operate, the pitch will be regulated so that the propeller acts in the water. If a vessel operates with a minimum of revolutions per minute of the main engine, this minimum RPM is probably sufficient most of the time for keeping the vessel in the right position, but also for supplying sufficient electricity for the vessel. This invention deals with a situation where weather conditions are with limited wind and limited current, and the different propellers are rotating at a reduced and controlled speed. In this situation, it is possible to reduce the RPM of the main engine and hereby reduce fuel consumption and thereby also reduce the pollution of operating the vessel. The fuel saving in good weather conditions can be as large as 30-50%. This is achieved by reducing, also mentioned here as optimizing, the RPM of the main engine and therefore also a propeller operating directly at the main shaft and at the same time, and probably also the speed of the thrust propellers, will be reduced, because the electric motors are operating with the frequency of the main generator connected to the main shaft. In order to have the same propulsion, the main propellers have to be regulated in their pitch, and possibly also the thrust propellers have to be regulated in their pitch, so they are operating sufficiently for keeping the correct position of the vessel. By decreasing the RPM of the main engine, it is also possible by increasing the pitch of both the main propeller and of the thruster propellers and thereby achieve sufficient propulsion and still reduce the total energy consumption. Other systems onboard a vessel are also connected to the same main generator as is the power supply, and this main generator will when the RPM is reduced also produce electricity with a reduced frequency. This problem can be overcome by an inverter which by a DC bridge converts the electricity to the correct frequency. The system can reduce the RPM of the Main Engine(s) to save fuel and compensate for this reduced RPM by adjusting the pitch of the Main Propeller(s) thereby maintaining the propulsion required to maintain position. Hereby lower RPM and fuel savings can be achieved while maintaining the propulsion and maintaining position.

The system can adjust the RPM of the main engine, which system performs compensation of the pitch of the one or more thruster propellers in order to maintain the propulsion power from the thruster propeller. Hereby it can be achieved that the thruster propeller can continue operating with the same propulsion as previously and maintain the ship's position by regulating the pitch of the thruster(s) propellers to compensate for the reduced RPM of the Thruster(s) motors due to the reduced AC power frequency delivered by the Shaft Generator(s).

The system can adjust the RPM of the main engine, which system performs compensation of the pitch of the main propeller in order to maintain the propulsion power from the main propeller. Hereby it can be achieved that also the main propeller can deliver the same propulsion power by changing the pitch when the at least one main engine runs with a lowered RPM, i.e. below the normal low threshold.

The system can adjust the pitch of at least one thruster propeller and compensate the pitch to maintain the propulsion power from the thruster propeller when the RPM of the main engine is reduced. Hereby it can be achieved that the thruster propeller is compensated by pitch regulation so that a reduction in the RPM is fully compensated for by change in pitch.

The system can adjust the pitch of at least one main propeller and compensate the pitch to maintain the propulsion power from the main propeller when the RPM of the main engine is reduced. The pitch can be regulated also on the propeller driven by the main engine in a manner by which the propulsion is maintained. Especially here there is a direct influence on the fuel consumption of a main engine.

The system can activate a frequency converter, such as an inverter with a DC bridge, which converts the electricity to the correct frequency for compensating for the lowered RPM level of the main engine, whereby the energy supply remains unaffected by the lowered RPM of the at least one main engine.

The system can comprise at least a first algorithm for adjustment of the RPM of the main engine in steps of fixed RPM. Hereby it can be achieved that different revolutions, for example unpleasant RPM because of resonance in the vessel can be avoided in the steps to be used.

The system can comprise at least a second algorithm for adjustment of the RPM of the main engine by dynamic changing of RPM. Another possibility is that the RPM of the at least one main engine is changed dynamically, i.e. it takes the RPM that is sufficient for the control of the vessel at a certain moment, and that a dynamic change is performed immediately in both directions depending on the actual need for power.

The system can, based on analysis of actual behaviour of the vessel and the actual pitch of the main propeller and the pitch of the thruster propeller, activate a first and/or a second algorithm of the system and disable the RPM adjustment of the main engine. In some situations a vessel may have a behaviour according to, for example, weather conditions or current by which one of the algorithms in the system, after a critical analysis of the behaviour of the vessel, will decide by itself to partly or fully disable the RPM adjustment so that the main engine of the vessel will accelerate to a higher RPM, in order to have sufficient power to avoid critical situations, e.g. because of the weather conditions around the vessel. The algorithm can be but is not limited to a proprietary algorithm to control Main Engine(s) RPM. The said algorithm can receive data about said external factors via various digital communication links with such commercially available systems including, but not limited to: Dynamic Positioning system(s), Power Management System(s), Weather detection or prediction systems, Collision Avoidance Systems, Master Control Systems, on board Fire Detection and Control systems, Vibration, Resonance, and Cavitation Detection Systems, and the ship's master control system.

The system can adjust the RPM of the main engine if the pitch of the thruster propeller enters at least one range of pitch, in order to e.g. suppress resonances, optimize the propulsion power, having sufficient range of available pitch of the thruster propeller. Hereby it can be achieved that a certain range of RPM is not to be used for operation, but that the system, as soon as possible, has to go to an RPM that is higher or lower than a frequency where resonance occurs. In fact, in a vessel there can be several resonance frequencies where the main engine will start a type of resonance oscillations somewhere in the vessel. These critical RPMs where resonance occurs could be controlled by the system. Some RPMs could be avoided simply by programming the system, but the system can also communicate with accelerometers placed at different positions in the vessel and in this way automatically measure resonance when it occurs in the mechanical construction, and in this way automatically perform suppression of the resonance. The algorithms can perform control of the Main Engine(s) RPM, based on analysis of the actual behaviour of the vessel and the external factors listed above, and the actual pitch of the Main Propeller(s) and the pitch of the Thruster(s), adjust the RPM down or up or even disable itself, returning the Main Engine(s) to 100% rated speed, i.e. normal operation mode. The system can be fully or partly disabled by certain conditions in the system or in further systems connected to the system. The system can disable the regulation if certain situations occur, such as changing weather conditions or on-board emergencies.

The system can by either of the algorithms also adjust the RPM of the main engine if the pitch of the main propeller enters at least one range of pitch, in order to e.g. suppress resonances, optimize the propulsion power, having sufficient range of available pitch of the main propeller. In the case of resonance, cavitations, vibration or other related factors are detected, the Control System(s) algorithm can step to the next speed, up or down, in the Electronic Gearbox. Hereby it can be achieved that a relatively low RPM can be held constant for a longer period of time, because the pitch of two or more of the propellers can be adjusted up and down as long as there is sufficient room of operation. Hereby it can also be achieved that resonance frequencies can be avoided if resonance occurs, because of the rotation of the propellers in the water. Hereby is achieved that, in situations where external power demand requires a higher yield from the main engine and the axle shaft generators, the RPM can be adjusted by means of the system to a normal speed of operation so as to overcome the power demand.

The system can, based on the actual load of one or more shaft generators perform control of the RPM of the main engine, based on the working conditions of said shaft generator, change in power consumption, need of larger/lower range of power consumption or available power on a bus bar. Increasing power demand in the other parts of the vessel may automatically increase the RPMs of the at least one main engine, such as up to the normal level, e.g. based on request by the frequency converters. This may be necessary in some situations for example because the frequency converters are overloaded because of the low frequency. That is the essence of this invention: the ability and knowledge to control the power of the Main Engine(s), either up or down depending upon conditions, thus saving fuel without compromising performance of any auxiliary system(s) dependent upon said Main Engine(s).

The system can adjust the RPM of the main engine, based on the actual load of one or more frequency converters connected to the shaft generator, which frequency converter reaches an upper or lower limit for one or more parameters for the operation of the frequency converters, such as changes in power consumption, need of larger/lower dynamic range of power consumption, or available power on a bus bar.

The system can, based on communication with other computer systems on board the vessel, such as a Dynamic Position Control system, perform regulation of the RPM of the main engine. By letting the system communicate with other systems onboard the vessel, it is possible that information from the dynamic position control can be used to regulate the RPMs of the main engine, and if problems occur due to the vessel moving away from the correct position, then automatic adjustment of the RPM could be made.

The system can be fully or partly disabled by certain conditions in the system or in further systems connected to the system. The system can disable the regulation if certain situations occur, such as changing weather conditions.

This invention also concerns a method comprising at east the following sequence of steps:

a: Analyse the RPM and the pitch of the main propeller (8),
b: analyse the RPM and the pitch of at least one thrust propeller (12),
c: analyse if pitch of the at least one main propeller (8) and the at least one thruster, propeller (12) has room for increasing the pitch,
d: optimize the RPM of the main engine (6),
e: optimize the pitch of the at least one main propeller (8),
f: optimize the pitch of at least one thrust propeller (12),
g: receive and analyse input from external systems,
h: repeat the analysis from a.

By the method as disclosed, it is possible to reduce the RPM of a main engine of any vessel operating maybe at stationary position or low speed simply by adjusting the RPM of the main engine downwards, e.g. below the normal lower threshold, and instead adjusting the pitch of the main and/or thrust propellers so that the total propulsion will be sufficient to maintain operational parameters. Reducing this RPM can have other consequences, so these algorithms compensate automatically, even up to the point of turning themselves off, thus maintaining the overall system control with no compromise in performance. By the reduction of the RPM of the main engine, the fuel consumption of the engine will be reduced by up to 40 or 50 percent and hereby considerably reducing operating costs and emissions.

DETAILED DESCRIPTION OF THE INVENTION

Figure 1:
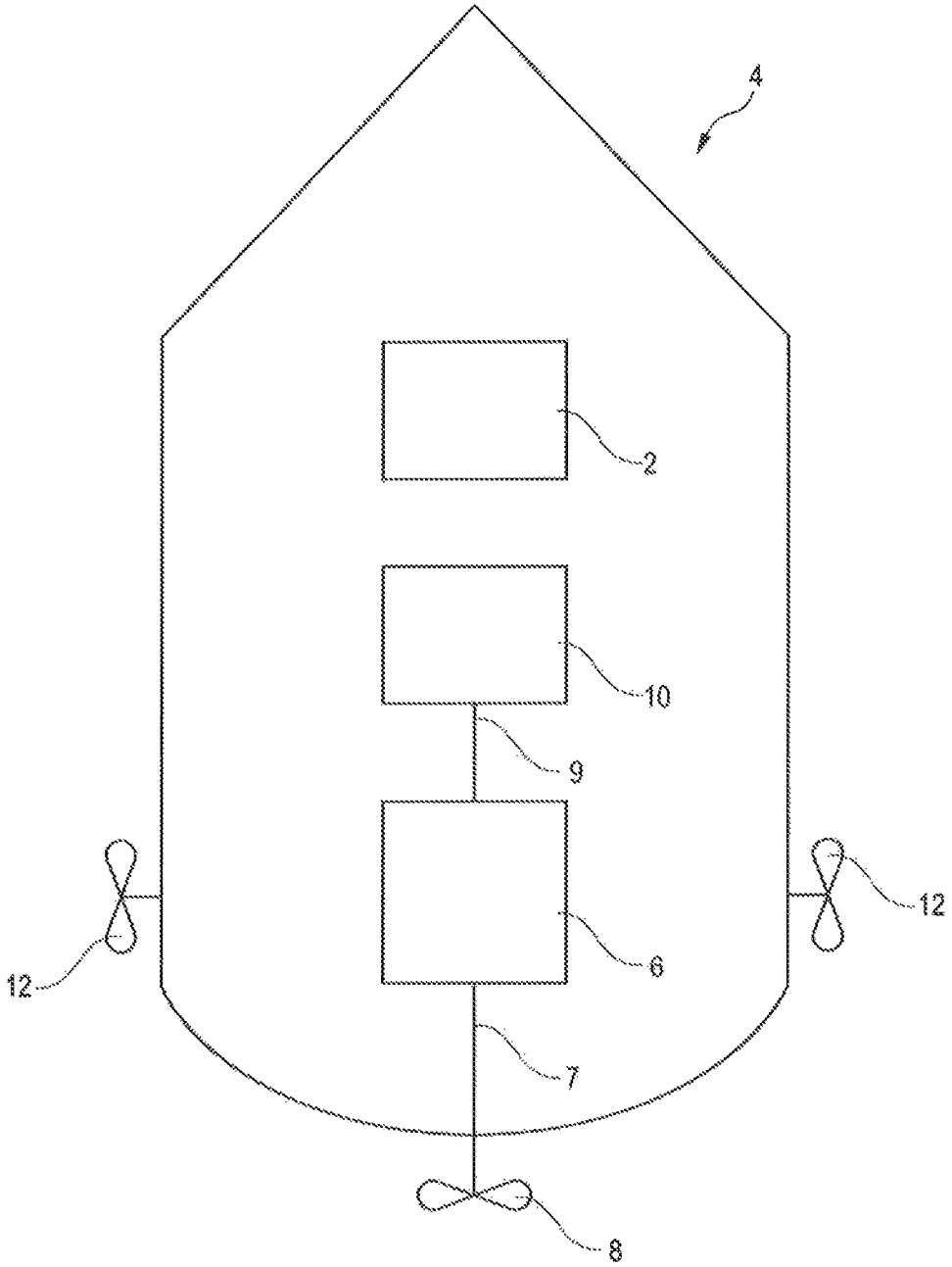
FIG. 1 shows a vessel comprising the system.

FIG. 1 shows a vessel 4 which vessel comprises the system 2. Further, the fig. shows a main engine 6 in the vessel which main engine 6 by a shaft 7 drives a main propeller 8. The main engine 6 further via shaft 9 drives a shaft generator 10. This shaft generator 10 is supplying power to electric engines for driving thrusters 12. Thruster propellers 12 are shown on the sides of the vessel.

In operation the system 2 can perform measurement and analysis of RPM of the propellers and of the pitch of the propellers. In situations where the vessel has to operate at a constant speed, or just be kept at a specific position, the engines have to operate, because there will always be a drift on the vessel caused by the wind or the water current. Therefore, in many situations where weather conditions are good, it is possible to reduce the RPM of the main engine, and instead change the pitch of the propellers by which the same propulsion can be achieved. This has the effect that fuel consumption and thereby pollution is reduced.

Figure 2:
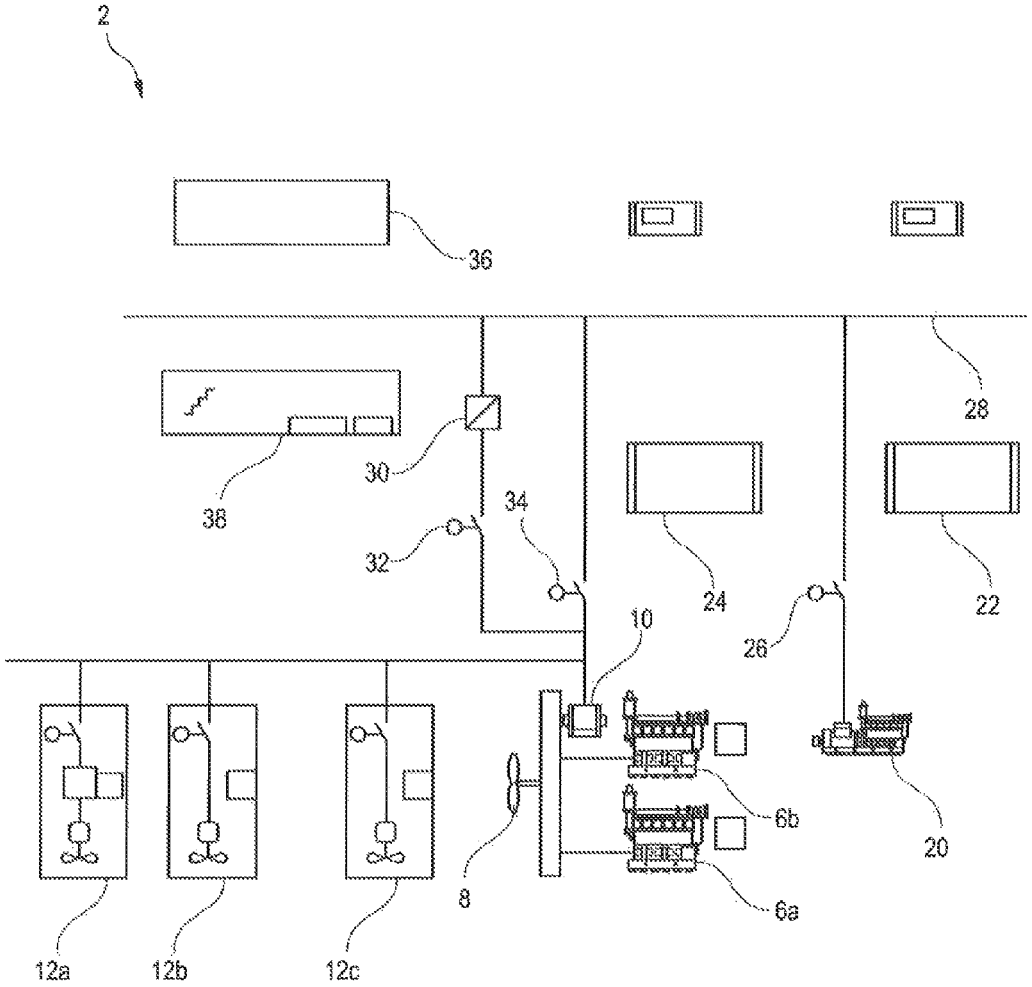
FIG. 2 shows the system operating in a vessel.

FIG. 2 shows the system 2 comprising two main engines 6A and 6B. These main engines 6A, 6B drive a main propeller 8 connected directly mechanically by a shaft and through a gear system. These main engines 6A and 6B further drive the shaft generator 10. This shaft generator 10 is connected to the thruster motors driving the thruster propellers 12A, 12B, 12C.

Further FIG. 2 shows a generator system 20. The generator of the system is controlled by the control system 22 or the control system 24. The main switch 26 is able to isolate generator 20 from a bus bar 28. Further, a switch 34 is indicated which is able to isolate the shaft generator from the bus bar. Further, over a line and a switch 32, a frequency converter 30 is indicated which frequency converter 30 is connected to the bus bar 28.

Further, a positioning system 36 is indicated. The positioning system 36 can communicate with an electronic gear box 38. The electronic gear box 38 can communicate with the thrusters and also with the pitch operation system of the main propeller 8. The electronic gear box 38 is able to adjust the RPM of the main shaft. In this way, the electronic gear box 38 can perform a very precise regulation of the main engine and in this way reduce the RPM and reduce the fuel consumption of the system.

The main engine 6A and 6B are normally operating at 785 RPMs corresponding to an output of the shaft generator of 60 hertz, 440 volts. To minimize the fuel consumption, the main idea is to reduce the speed of the main engine, e.g. to 500 RPMs which will reduce the output of the shaft generator to 38.2 hertz, 280 volts when feeding the thrusters. However, this will reduce the thruster power which has to be compensated for by more pitch.

When max. pitch is reached, the speed of the main engines must be increased to increase thruster power. One example of the electronic gear box 38 is an electronic gear box of fixed RPM such as 500, 550, 600, 650, 700, 750, 785 RPM which is used in the heart of the control algorithm. If the thruster power demand is increased to a higher value than what the actual main engine speed RPM can supply, the thruster power is increased by a calculated main engine RPM increased with a short delay of 1-5 seconds.

When the thruster power again decreases, the main engine RPM can be decreased. To obtain a hysteresis, the main engine RPM will be decreased after a delay of 30-60 seconds to a lower level, depending on the thruster maximum power during this period. The hysteresis avoids that the main engine RPM will keep going up and down, and the thruster power is mainly controlled by the thruster pitch. It is taken into consideration which of the bow thruster, stern thruster, or main propeller which has the highest power demand. The thruster having the maximum power demand will determine the minimum main engine speed in the electronic gear box.

Figure 3:
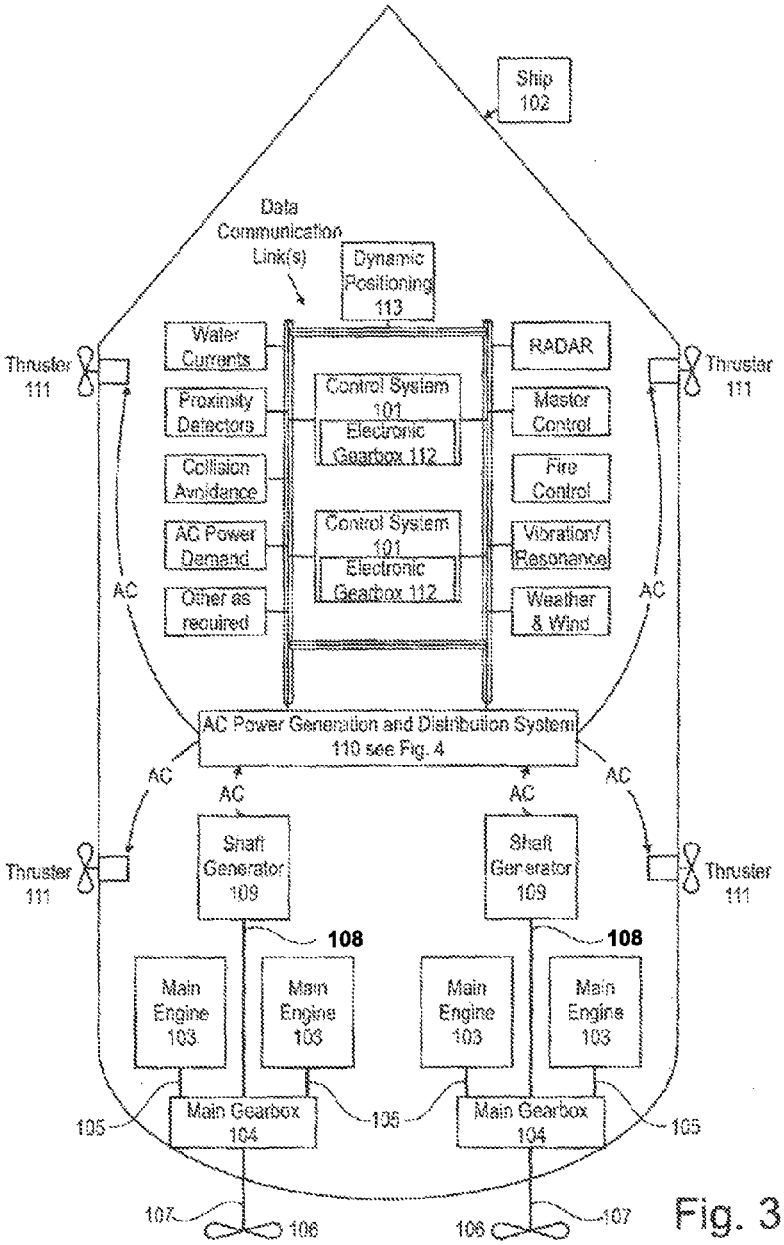
FIG. 3 shows a simplified drawing of a ship comprised of the Control System.
Figure 4:
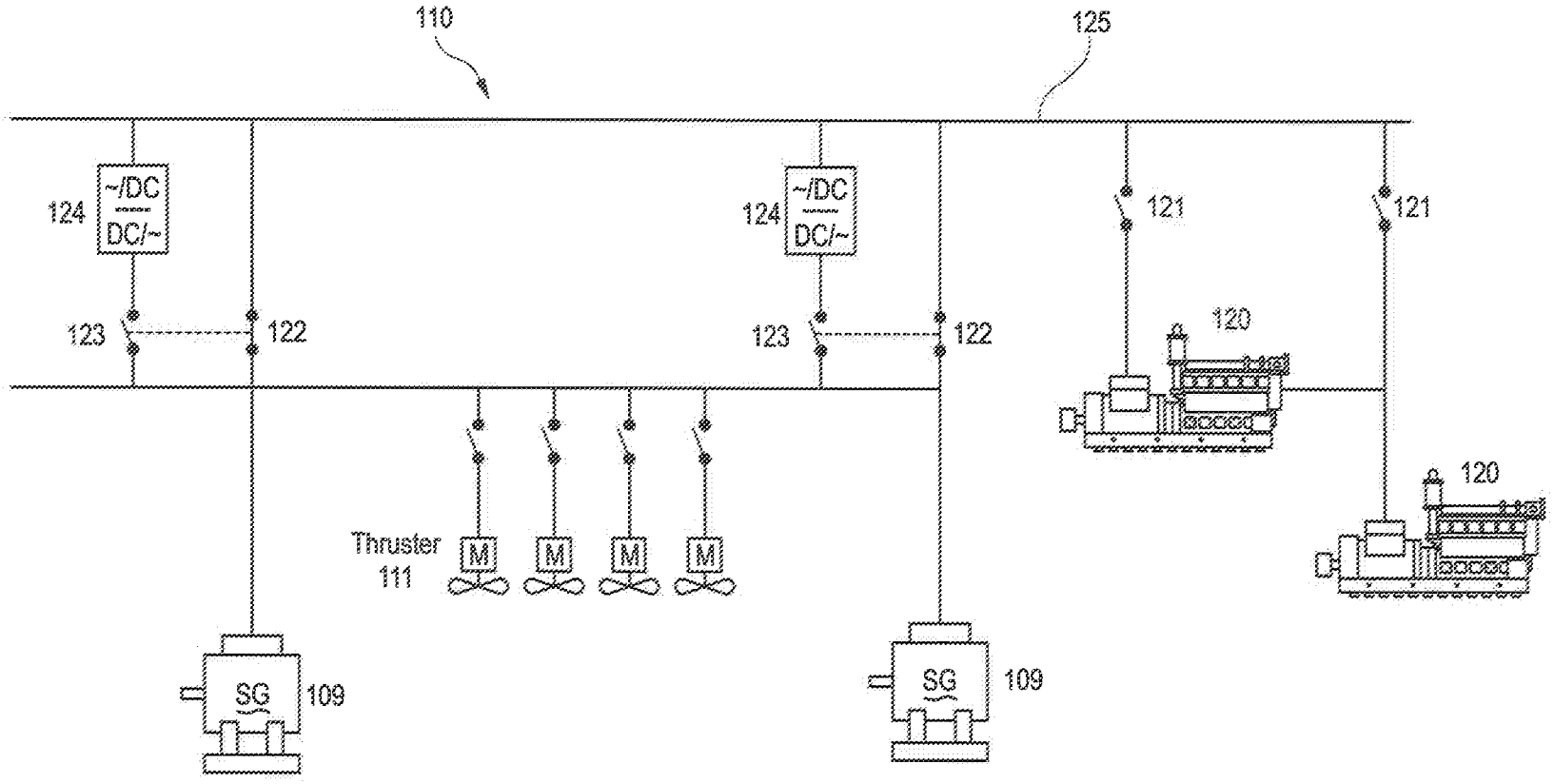
FIG. 4 shows more details of the components of FIG. 3.

FIG. 3 shows a simplified drawing of a vessel such as a ship 102 comprised of the Control System(s) 101, mechanical system with Main Engine(s) 103, Main Gear-box(es) 104, Main Propeller(s) 106, Shaft Generator(s) 109, and AC Power Generation and Distribution System 110 which is shown in more detail in FIG. 4. FIG. 3 shows a redundant system with two of each major component, but a single, non-redundant system is possible. Further, FIG. 3 shows a Main Engine(s) 103 in the ship which Main Engine(s) 103 by a shaft 105 turns the Main Gearbox(es) 104 which turns Main Propeller(s) 106 via shaft 107. The Main Engine(s) 103 further, via shaft 108 drives a Shaft Generator(s) 109. This Shaft Generator(s) 109 is supplying AC power to electric motors for driving Thruster(s) 111. Thruster propellers are shown on the sides of the ship, but they may be any type of AC motor powered thrusters, including, but not limited to, tunnel thrusters and azimuth thrusters.

In operation, the Control System(s) 101 can perform measurement and analysis of the RPM and pitch of all of the propellers used to control the ship. In situations where the ship has to operate at a constant speed, or be kept at a specific position, the engines have to operate, because there will always be a drift on the ship by caused by the wind or the water current. Therefore, in many situations where weather conditions are good, it is possible to reduce the RPM of the Main Engine(s) 103 below the normal lower threshold, and change the pitch of the Main Propeller(s) 106 in order to achieve the same propulsion. This has the desired effect to reduce fuel consumption and thereby reduce pollution.

FIG. 4 shows more details of the components of FIG. 3. The Main Engine(s) 103 drive a Main Propeller 106 connected directly mechanically by a shaft and through a Main Gearbox(es) 104 system. These Main Engine(s) 103 also drive the Shaft Generator(s) 109. This Shaft Generator(s) 109 supplies AC electrical power to the Thruster(s) 111 that turn the thruster propellers 111.

Further, FIG. 4 shows more details of the AC Power Generation and Distribution System 110 of FIG. 3. Said AC Power Generation and Distribution System 110 consists of the Shaft Generator(s) 109 with their associated switches 122, internal combustion engine driven AC power generators 120 with their associated switches 121, Auxiliary AC Power Inverters 124 with their associated switches 123, all controlled by the Control System(s) 110. Shown on these figures are identical, redundant, systems to provide maximum reliability and to meet industry standards and codes. Switch 121 is able to isolate generator(s) 120 from a bus bar 125. Shaft generator(s) 109 may be connected to supply AC power to bus bar 125 via either switch 122 or via Auxiliary Power Inverter(s) 124. Switches 122 and 123 are interlocked so both may not be closed at the same time during periods when the Shaft Generator(s) 109 are operated at speeds other than nominal speed.

Further a Dynamic Positioning System 113 is indicated at FIG. 3. This Dynamic Positioning System 113 is one of many different inputs the Control System(s) 101 that may be programmed to affect the Electronic Gearbox 112 function of the Control System(s) 101. The Electronic Gearbox 112 is a database of RPMs at which the Main Engine(s) 103 are allowed to operate. In this way, the Electronic Gearbox 112 can perform a very precise regulation of the Main Engine(s) 103 and in this way reduce the RPM and reduce the fuel consumption of the system.

In a test system, the Main Engine(s) 103 are normally operating at 785 RPMs corresponding to an output of the Shaft Generator(s) 109 of 60 hertz, 440 volts. To minimize the fuel consumption, the main idea is to reduce the speed of the Main Engine(s) 103 to, for example, 500 RPMs which will reduce the output of the Shaft Generator(s) 9 to 38.2 hertz, 280 volts when feeding the Thruster(s) 111. However, this reduced frequency will reduce the thrust produced by the Thruster(s) 111 which will be compensated for by adjusting the pitch of the thruster propeller(s).

When the pitch of any of the propellers reaches preprogrammed limits, the speed of the Main Engine(s) 103 must be regulated to maintain thrust. One example of the Electronic Gearbox 112 is a set of fixed, pre-programmed Main Engine(s) 103 RPMs such as 500, 550, 600, 650, 700, 750, 785 RPM which are used by the primary control algorithm. If the thrust demand is more than can be obtained by the pitch control at the exiting RPM, the Control System(s) 1 algorithms, after a short programmable delay of 1-5 seconds, increase the Main Engine(s) 103 RPMs to the next value in the Electronic Gearbox 112.

Conversely, when the thrust demand decreases, the Control System(s) 101 algorithms can reduce the Main Engine(s) 103 RPMs to the next lower value in the Electronic Gearbox 112 after a delay of 30-60 seconds to provide a hysteresis and prevent oscillations or hunting of the system.

Thrust demand is determined by the Control System(s) 101 by reading the pitch of all propellers, thruster and Main Propeller(s) 106. The Thruster(s) 111 or Main Propeller(s) 106 having the maximum thrust demand will determine the minimum Main Engine(s) 103 speed from the values stored in the Electronic Gearbox 112.

Any number of external factors could be included in the Main Engine(s) 103 RPM control algorithm including, but not limited to: manual operator intervention, a change in the ship's position away from the desired position, if resonance, cavitation, or excessive vibration are detected, if increased wind or water currents are detected, if there are increased demands for electrical power in the ship's other systems, if radar or other detection methods of proximity to other ships, land, obstructions, or weather patterns, fire suppression or other control demands, the Main Engine(s) 103 RPM will be adjusted in stages by the control algorithm until sufficient power is produced to meet the demand, including an adjustable reserve.

Figure 5:
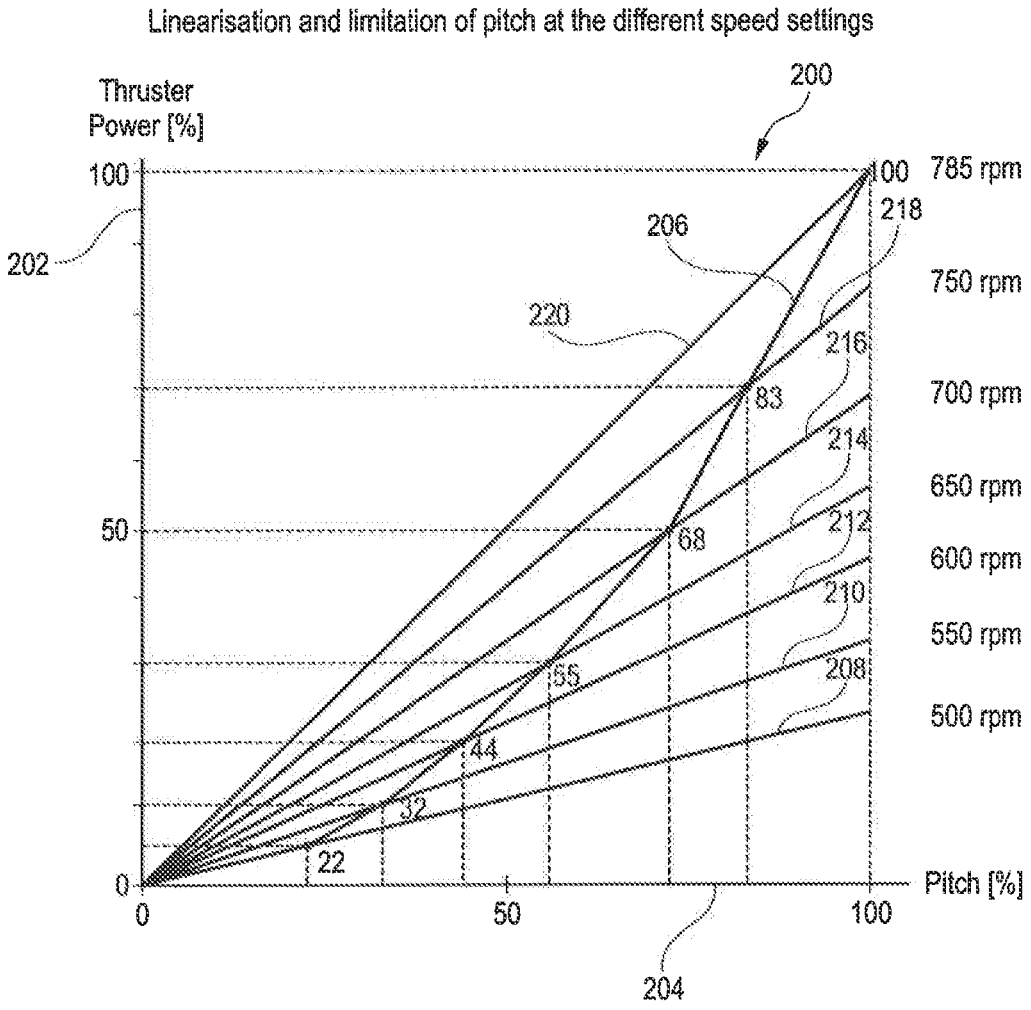
FIG. 5 shows a curvature of the relation between power and pitch.

FIG. 5 shows one possible curvature 200 having a first axis 202 indicating thruster power and another axis 204 indicating the pitch percent. It has been found that correct relationship between thruster power and pitch percent will form the cuverture is parabolic. This curve 206 is at FIG. 5 comprises linear sections for some areas indicating a relation between RPM and percentages of pitch. The curve 206 indicates the correct relationship. At the curve it can be seen that if the RPM of the thruster power 6-500 RPM, then the curve 208 meets the curve 206 with a pitch percent of 22. This indicates that by 500 RPM regulation is only possible from 0-22%. It means that the 100% pitch will only lead to a thrust of 22%. If higher power is needed then the engine will have to rotate at a higher speed, next level will be 550 RPM and then the level is defined by the curve 210 and its crossing with line 206. Therefore, a power from 22-32% is possible in that level. If further higher level of power is needed then the engine has to rotate at 600 RPM and the curve 212 will be active. Therefore now a level from 32-44% will be effective. Further with a curve 214 and 650 RPM it is possible to control from 44-55%. Further by the line 216 is possible to perform a control at 700 RPM from 55-68%. Once again with the line 208 it is possible to perform regulations from 68-83% and further from the line 220 it is possible to perform regulations in the field 83-100%. In this way a simple algorithm can be designed using a linear function at each fixed speed. When 100% is reached at a given RPM, the RPM have to be increased to give more thrust.

Because the whole system can operate in a common algorithm it is possible to let regulations he made in a very fast manner so regulation will be performed mostly as a dynamic process.

Definitions Used in this Description of the Invention

Control System(s) are the processor(s)/computer(s) that make the decisions on the operation of the power system based on data received from various sources.

Often there is more than one Control System on a ship, sometimes operating redundantly to each other, thus the term Control System(s) refers to them collectively.

Main Engine(s) are the largest engines on a ship, often but not limited to reciprocating internal combustion engines, and in this invention, turn a Main Propeller(s), normally via a Main Gearbox(es). Often there is more than one Main Engine on a ship, thus the term Main Engine(s) refers to all of them collectively.

Main Propeller(s) 106 are turned by the Main Engine(s) via the Main Gearbox(es). Often there is more than one Main Propeller, thus the term Main Propeller(s) refers to all of them collectively. The pitch of the Main Propeller(s) is controlled to vary the propulsion or thrust produced.

Main Gearbox(es) are the mechanical interface and (sometimes) speed reduction between the Main Engine(s) 1033 and their respective Main Propeller(s). Often there is more than one Main Gearbox, thus the term Main Gearbox(es) refers to all of them collectively. The Main Gearbox(es) have an output shaft that turns one or more Shaft Generator(s).

Shaft Generator(s) are alternating current (AC) generators that produce AC electrical power (hereafter 'electrical power' or 'AC power') to energize the ships electrical systems. Often there is more than one Shaft Generator, thus the term Shaft Generator(s) refer to all of them collectively.

Thruster(s) is a generic term to describe any of the auxiliary positioning propeller(s) not driven directly by the Main Engine(s). The pitch of these auxiliary positioning propeller(s) is controlled to vary the propulsion or thrust produced. Thruster(s) consist of a motor or engine that drives a thruster propeller, thus the industry accepted simplified term 'Thruster' is normally used. While a Thruster may be powered by either an AC motor or a reciprocating internal combustion engine, in this invention they are powered by an AC motor. Often there is more than one Thruster, thus the term Thruster(s) 11 refers to them all collectively.

Auxiliary AC Power Inverter(s) are used to provide a stable power, normally 50 or 60 Hz, when the Shaft Generator(s) are not turning at the correct RPM to produce the nominal frequency AC power. These commercially available devices convert almost any frequency AC power into DC and back into the correct nominal AC power for the ship, normally 50 Hz, or 60 Hz. There could be more than one inverter, thus the term Auxiliary AC Power Inverter(s) refers to them all collectively.

The invention claimed is:

1. A control system which is configured for controlling and optimizing the RPM of at least one main engine of a vessel, which main engine is configured to drive at least one pitch regulated main propeller for propulsion, which main engine is configured to drive at least one main generator in such a way that reducing the speed of the main engine will reduce the frequency output of the main generator, which main generator is configured to drive at least one thruster motor, which thruster motor is configured to drive at least one thruster propeller that is pitch-regulated, wherein the at least one thruster motor is connected to the main generator in such a way that reducing the speed of the main engine will reduce the speed of the thruster propellers because the at least one thruster motor is operating with the frequency of the main generator connected to the main shaft and the control system is configured to perform an analysis of the RPM and pitch of the main shaft propeller, the RPM and the pitch of the thruster propeller, which control system is configured to operate based on said analysis and which control system is configured to receive a plurality of input from other control systems in the vessel, and to perform regulation of the RPM of the main engine between a low and a high threshold level during normal operation of the vessel, the RPM of the main engine by lowering the RPM of the main engine to a level below the low threshold RPM level during a period when the vessel is maintaining a constant position or a constant low speed, and the pitch of at least the main propeller for compensating for the low RPM level of the main engine.

2. The control system according to claim 1, wherein the system is configured to perform compensation of the pitch of the thruster propeller in order to maintain the propulsion power from the thruster propeller.

3. The control system according claim 1, wherein the system is configured to adjust the pitch of at least one thruster propeller and to compensate the pitch to maintain the propulsion power from the thruster propeller when the RPM of the main engine is optimized.

4. The control system according to claim 1, wherein the system is configured to activate a frequency converter configured to convert the electricity to the correct frequency, for compensating for the lowered RPM level of the main engine.

5. The control system according to claim 1, wherein the control system comprises at least a first algorithm for optimizing of the RPM of the main engine in steps of fixed RPM.

6. The control system according to claim 5, wherein the control system comprises at least a second algorithm for adjusting the RPM of the main engine by dynamic optimizing of RPM.

7. The control system according to claim 6, wherein the control system based on the analysis of the actual behaviour of the vessel, the actual pitch of the main propeller, the pitch of the thruster propeller, and at least one of the first or the second algorithm of the control system is configured to disable the RPM adjustment of the main engine.

8. The control system according to claim 1, wherein the control system is configured to adjust the RPM of the main engine if the pitch of the thruster propeller enters at least one undesired range of pitch.

9. The control system according to claim 1, wherein the control system is configured to adjust the RPM of the main engine if the pitch of the main propeller enters at least one undesired range of pitch.

10. The control system according to claim 1, wherein the control system based on the actual load of one or more generators is configured to perform control of the RPM of the main engine, based on the working conditions of said generator, change in power consumption, need of larger/lower range of power consumption or available power on a bus bar.

11. The control system according to claim 1, wherein the control system is configured to adjust the RPM of the main engine as a function of the actual load of one or more frequency converters connected to the main generator and as a function of one or more frequency converters reaching an upper or lower limit for one or more parameters for the operation of the frequency converters, such parameters being changes in power consumption, need of larger/lower dynamic range of power consumption, or available power on a bus bar.

12. The control system according to claim 1, wherein the control system, based on communication with other systems on board the vessel is configured to perform regulation of the RPM of the main engine.

* * * * *